US005594616A

United States Patent [19]

Brecht et al.

[11] Patent Number: 5,594,616

[45] Date of Patent: Jan. 14, 1997

[54] ELECTRICAL COMPONENT CONNECTING PROVISIONS FOR AN IGNITION COIL

[75] Inventors: David C. Brecht, Ann Arbor; Robert C. Bauman, Flat Rock; Robert L. Hancock, Ann Arbor, all of Mich.

[73] Assignee: Ford Motor Company, Dearborn, Mich.

[21] Appl. No.: 411,195

[22] Filed: Mar. 27, 1995

[51] Int. Cl.[6] ..... F02P 11/00

[52] U.S. Cl. ..... 361/622; 29/748; 123/655; 336/185; 361/263

[58] Field of Search ..... 336/185; 439/620; 123/633, 634, 655; 29/605, 748; 361/600, 601, 622, 623, 728, 807, 809–811, 253, 263, 256, 257

[56] References Cited

U.S. PATENT DOCUMENTS

| | | | |
|---|---|---|---|
| 4,308,488 | 12/1981 | Imai et al. . | |
| 4,327,702 | 5/1982 | Imai et al. . | |
| 4,846,129 | 7/1989 | Noble | 123/425 |
| 5,109,828 | 5/1992 | Tagami et al. . | |
| 5,241,941 | 9/1993 | Hancock et al. . | |
| 5,278,728 | 1/1994 | Blankenship et al. . | |
| 5,419,300 | 5/1995 | Maruyama | 123/634 |

FOREIGN PATENT DOCUMENTS 56-135747A 10/1981 Japan .

*Primary Examiner*—Gerald P. Tolin
*Attorney, Agent, or Firm*—Mark S. Sparschu

[57] ABSTRACT

In one embodiment of the present invention, an ignition coil assembly includes a primary coil and a secondary coil. A primary connector assembly of the ignition coil assembly includes a conductor which is adapted to electrically connect one terminal of the primary coil with one terminal of the secondary coil. The conductor includes indentations which delimit a portion of the conductor and facilitate the removal of that portion of the conductor. The conductor further includes provisions for electrically connecting an electrical component such as diode in place of the removed portion of the conductor. The present invention thus facilitates inclusion of an electrical component such as a diode in applications which will benefit from the inclusion of the electrical component in place of the conductor.

14 Claims, 3 Drawing Sheets

ELECTRICAL COMPONENT CONNECTING PROVISIONS FOR AN IGNITION COIL

BACKGROUND OF THE INVENTION

1. Field of the Invention

The present invention relates to ignition systems for motor vehicles.

2. Description of the Related Art

In an ignition system for a motor vehicle, electrical energy is typically converted from low voltage (typically 12 volts) to high voltage for the firing of the spark plugs of the engine of the vehicle. The conversion normally takes place through an ignition coil assembly having a primary coil and a secondary coil, the coils magnetically coupled to one another. A controller causes electrical current to increase to a predetermined level at a relatively slow rate in the primary coil. Once at the predetermined level, the controller abruptly breaks the current. The result is a large voltage induced in the secondary coil. This large voltage causes a spark across the gap of a spark plug electrically connected to the secondary coil. This spark ignites an air-fuel mixture in the engine.

A problem can be encountered with an ignition system operating as just described. This problem can occur if the spark plug has a very small gap. In this event, the current building up in the primary coils which induces a (relatively small) voltage in the secondary coil, can induce enough voltage to cause a spark across the gap of the spark plug. This spark, totally unintended, may cause pre-ignition in the engine.

One possible solution to this problem is the addition of a diode in series between the secondary coil and the spark plug. This diode takes advantage of the fact that the unintended spark (and attendant current flow between the secondary coil and the spark gap) is in the opposite direction from the intended spark produced by the ignition coil assembly. The diode will block the unintended current flow which may otherwise tend to occur.

Although this solution may be effective, the usual way in which it is normally applied has at least one limitation. Generally, such a diode is incorporated in such a manner that leaving the diode off for applications in which it is not needed (i.e., applications with relatively normal spark gap sizes) is not practical. The result is that for all applications in which the ignition coil is used, the diode is included. Obviously, this is wasteful in the case of applications where the diode is not needed.

Therefore, an ignition coil design which easily allows a diode to be incorporated as needed will provide advantages over alternative solutions.

SUMMARY OF THE INVENTION

The present invention provides an ignition coil assembly. The ignition coil assembly comprises a primary coil having a first terminal and a second terminal. The ignition coil assembly further includes a secondary coil having a third terminal and a fourth terminal, the secondary coil magnetically coupled to the primary coil. Also, the ignition coil assembly includes an electrical component electrically connected between one terminal of the primary coil and one terminal of the secondary coil.

The present invention further provides a second ignition coil assembly. The second ignition coil assembly includes a primary coil having a first terminal and a second terminal. Additionally, the second ignition coil assembly comprises a secondary coil having a third terminal and a fourth terminal, the secondary coil magnetically coupled to the primary coil. Further, the second ignition coil assembly includes a conductor electrically coupling one terminal of the primary coil and one terminal of the secondary coil, the conductor comprising provisions for connection of an electrical component across a portion of the conductor.

The present invention also provides a method for assembling an ignition coil assembly. The method includes the steps of providing a primary coil with a first terminal and a second terminals and providing a secondary coil with a third terminal and a fourth terminal. The method also includes the step of providing a conductor adapted to electrically connect a terminal of the primary coil with a terminal of the secondary coil. Also, the method comprises the step of removing a portion of the conductor. Further, the method includes the step of electrically connecting an electrical component in place of the removed portion of the conductor.

The present invention allows a diode to be easily incorporated into an ignition coil assembly as needed. In doing so, the present invention provides improvements in manufacturing efficiency over alternative solutions.

BRIEF DESCRIPTION OF THE DRAWINGS

FIG. 6 is a bottom view of a primary connector assembly 12C with a modified diode attaching provision.

DETAILED DESCRIPTION OF THE PREFERRED EMBODIMENT

Figure 1:
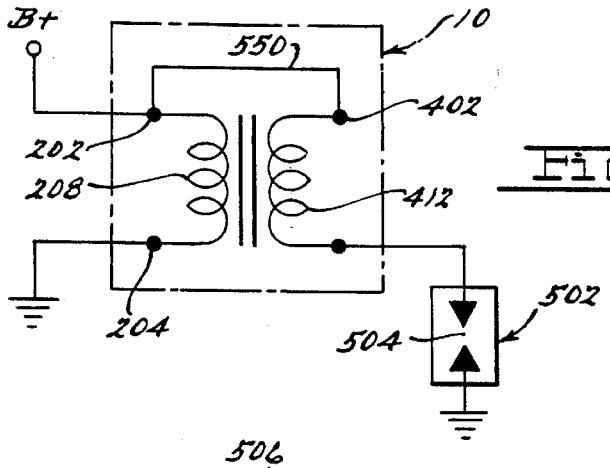
FIG. 1 is an electrical schematic of ignition coil assembly 10 and spark plug 502 of an ignition system.

Referring to FIG. 1 an electrical schematic of ignition coil assembly 10 is presented. Ignition coil assembly 10 comprises primary coil 208 and secondary coil 412. These two coils are magnetically coupled. The coils are further electrically coupled by a conductor 550. Primary coil 208 is connected to ground and to a positive terminal B+.

Secondary coil 412 is connected, as mentioned above, at one end to primary coil 208. At its other end, secondary coil 412 is connected to spark plug 502. Spark plug 502 has a spark gap 504. A spark induced across this gap by ignition coil assembly 10 causes ignition of a fuel-air mixture in the engine on which spark plug 502 is mounted.

The operation of ignition coil assembly 10 is as follows. Primary coil 208 is provided a time-increasing current via a controller (not shown) connected across the B+ and ground connections of primary coil 208. Once that time-increasing current has reached a predetermined value, the controller abruptly cuts off the current through primary coil 208. This causes a large time rate of change of current (di/dt) through primary coil 208, which induces a large voltage across secondary coil 412. This voltage is large enough to cause a spark across gap 504 of spark plug 502 (from top to bottom as viewed in FIG. 1), thereby providing ignition for the fuel-air mixture in the engine.

This scenario works well enough as long as spark gap 504 is of at least a minimum width. However, if spark gap 504 is of a smaller width (as used in some engines), a problem can arise. This problem can arise because the "charging" of primary coil 208 with current has a di/dt. Although this di/dt is very small relative to the di/dt which occurs when the current through primary coil 208 is abruptly cut off the former di/dt may be large enough to cause a (very unintended) spark across a small spark gap 504. This spark would be from bottom to top as viewed in FIG. 1. An unintended "pre-ignition" may occur because of this unintended spark.

Figure 2:
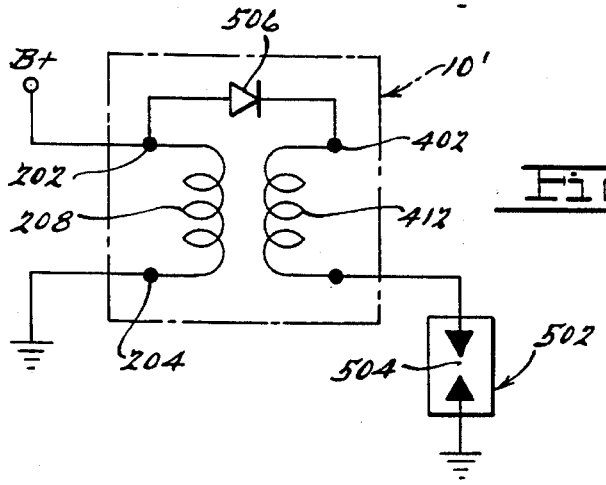
FIG. 2 is an electrical schematic of a modified ignition coil assembly 10' and spark plug 502 of an ignition system.

When a small spark gap 504 is used, therefore, a solution to prevent such pre-ignition is desirable. One such solution is illustrated in FIG. 2. In FIG. 2, diode 506 is added between primary coil 208 and secondary coil 412. Diode 506 allows current flow through spark plug 502 only in the (intended) top-to-bottom direction as viewed in FIG. 2. Current flow in the opposite direction will be blocked.

An important consideration in the design of ignition coil assembly 10 is that not all uses of ignition coil 10 require diode 506. Only the use of ignition coil 10 with a spark plug 502 having a small spark gap 504 will require diode 506.

Figure 3:
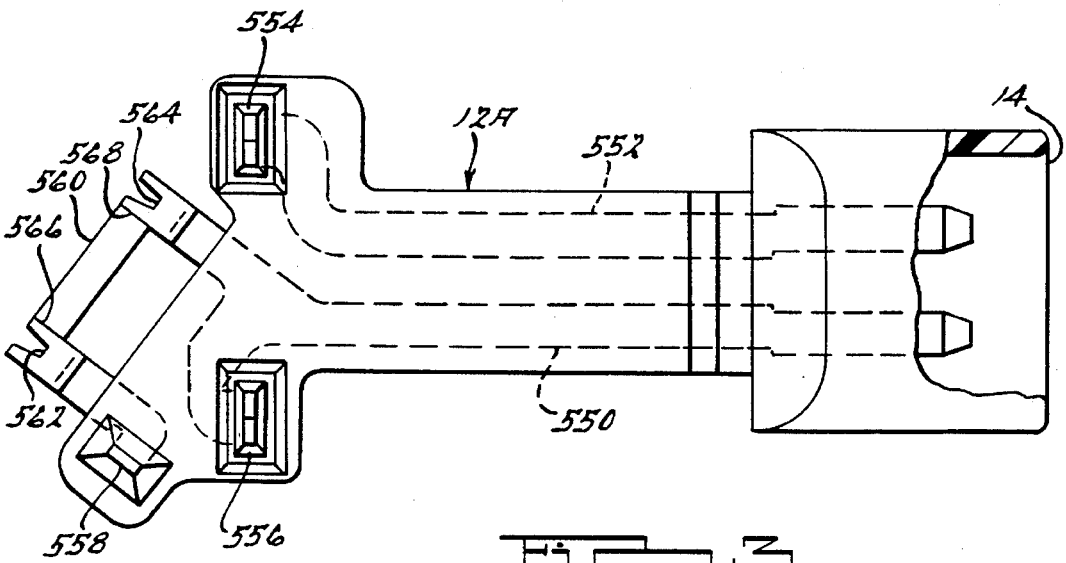
FIG. 3 is a bottom view of a primary connector assembly 12A for ignition coil assembly 10.

FIG. 3 illustrates provisions which allow diode 506 to be used if needed, and not used if not needed. Diode 506 is included (if needed) in primary connector assembly 12A of ignition coil assembly 10. Primary connector assembly 12A is preferably an insert-molded plastic component which includes conductors 550 and 552. Conductors 550 and 552 each terminate at one end in receptacle portion 14. Conductors 550 and 552 are thus presented for connection with a connector (not shown) which connects ignition coil assembly 10 with the aforementioned controller which controls it. Conductor 552 terminates at its other end in terminal 554, which in turn makes connection to terminal 204 of primary coil 208 (FIG. 1) when primary connector assembly 12A is assembled to the remainder of ignition coil assembly 10. The assembly of primary connector assembly 12A to the remainder of ignition coil assembly 10 is illustrated in greater detail in U.S. Pat. No. 5,241,941, issued to Hancock et al on Sep. 7, 1993. The specification of that patent from column 3, line 61 to column 5, line 39 and FIG. 2 is hereby incorporated by reference.

Conductor 550 terminates in terminal 556. Terminal 556 connects to terminal 202 of primary coil 208 (FIG. 1). Conductor 550 also terminates in terminal 558. Terminal 558 connects to terminal 402 of secondary coil 412 (FIG. 1). Conductor 550 reaches terminal 558 via a conductive strip 560. At the ends of conductive strip 560 are two crimp connectors 562 and 564. Also at the ends of conductive strip 560 are indentations 566 and 568.

Figure 4:
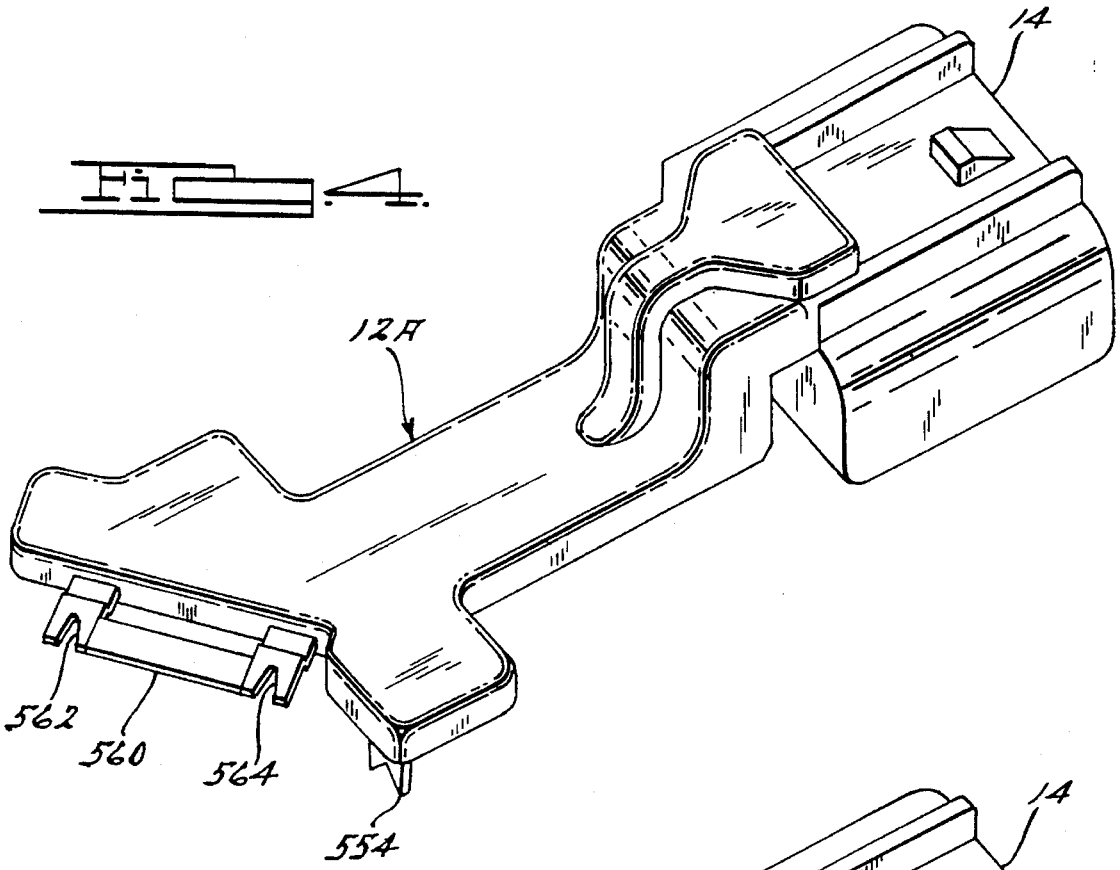
FIG. 4 is a perspective view of primary connector assembly 12A.

If diode 506 is not required for a particular application of ignition coil 10, primary connector assembly 12A is used as shown in FIG. 3. The resulting electrical schematic of ignition coil 10 will be that shown in FIG. 1. A perspective view of primary connector assembly 12A in this condition is shown in FIG. 4.

Figure 5:
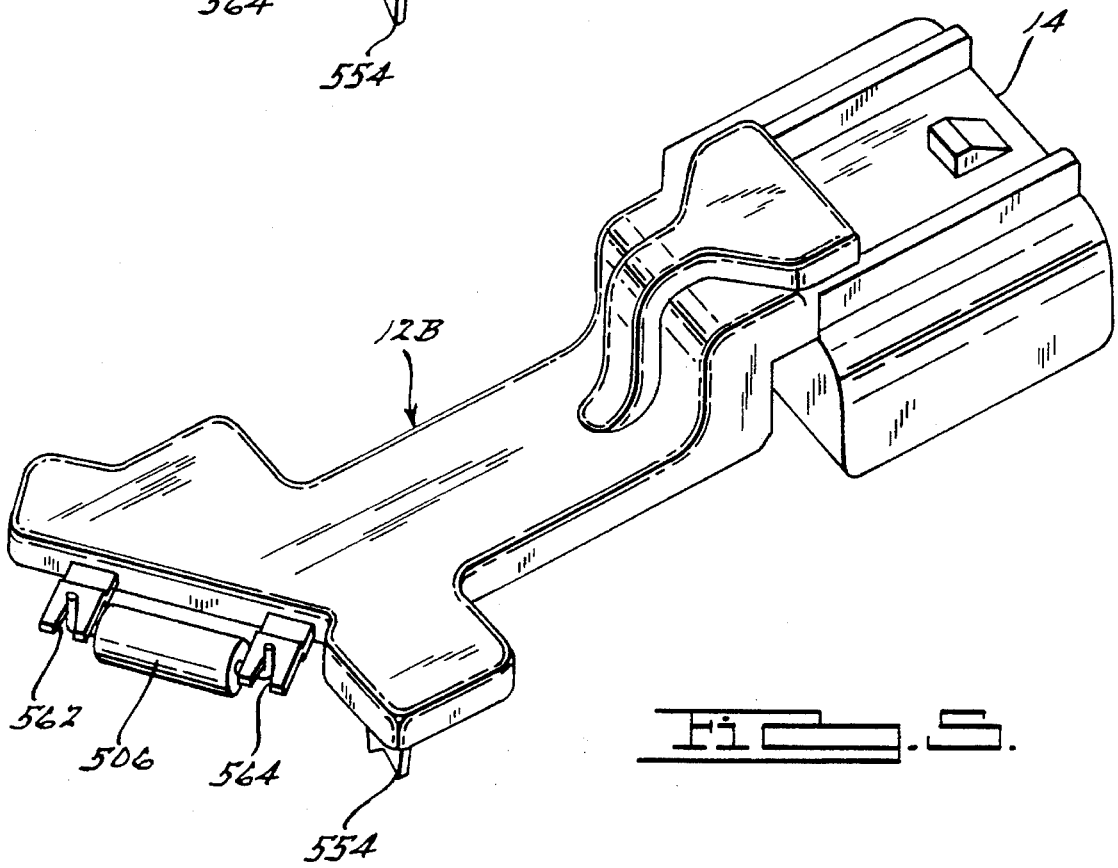
FIG. 5 is a perspective view of a modified primary connector assembly 12B, for use with ignition coil assembly 10'.
Figure 5:
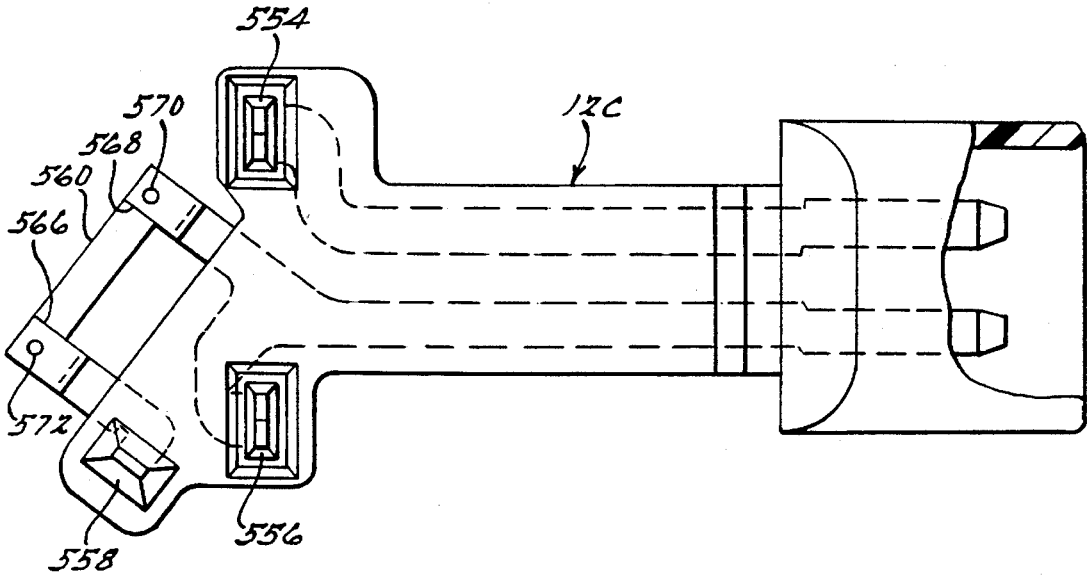

However, if diode 506 is required for a particular application of ignition coil 10, conductive strip 560 is punched out. Indentations 566 and 568 facilitate punching conductive strip 560 out. Diode 506 is then added, one lead crimped into crimp connector 562 and one lead crimped into crimp connector 564. Soldering can optionally be used in addition, for added electrical and mechanical reliability of the crimp connections. The resulting electrical schematic of ignition coil 10 will be that shown in FIG. 2. A perspective view of the primary connector assembly (designated 12B as modified due to inclusion of diode 506) in this condition is shown in FIG. 5.

It will thus be recognized that a single primary connector assembly 12A can be produced for all ignition coil assemblies 10, regardless of whether a diode 506 is needed or not. Diode 506 can then be added if required. Improved manufacturing efficiencies result from only having to produce a single primary connector assembly 12A.

FIG. 6 shows a modified primary connector assembly 12C. Primary connector assembly 12C allows the addition of diode 506 (if needed) by soldering without crimping. FIG. 6 illustrates two holes 570 and 572, into each of which a lead of diode 506 can be inserted. Soldering can then be employed to electrically and mechanically connect the leads of diode 506 to primary connector assembly 12C.

Various other modifications and variations will no doubt occur to those skilled in the arts to which this invention pertains. Such variations which generally rely on the teachings through which this disclosure has advanced the art are properly considered within the scope of this invention. This disclosure should thus be considered illustrative, not limiting; the scope of the invention is instead defined by the following claims.

What is claimed is:

1. An ignition coil assembly comprising:

a primary coil having a first terminal and a second terminal;

a secondary coil having a third terminal and a fourth terminal, said secondary coil magnetically coupled to said primary coil; and a conductor electrically coupling one said terminal of said primary coil and one said terminal of said secondary coil, said conductor comprising means for connecting an electrical component across a portion of said conductor.

2. An ignition coil assembly as recited in claim 1, wherein said means include two holes adapted for insertion of two leads of a leaded electrical component.

3. An ignition coil assembly as recited in claim 1, wherein said means include two crimp connections adapted to grasp two leads of a leaded electrical component.

4. An ignition coil assembly as recited in claim 2 further comprising means for aiding removal of said portion of said conductor.

5. An ignition coil assembly as recited in claim 4 wherein said removal aiding means include indentations delimiting boundaries of said portion.

6. An ignition coil assembly as recited in claim 3 further comprising means adapted to aid removal of said portion of said conductor.

7. An ignition coil assembly as recited in claim 6 wherein said removal aiding means include indentations delimiting boundaries of said portion.

8. A method for assembling an ignition coil assembly, said method comprising the steps of:

(a) providing a primary coil with a first terminal and a second terminal;

(b) providing a secondary coil with a third terminal and a fourth terminal;

(c) providing a conductor adapted to electrically connect a said terminal of said primary coil with a said terminal of said secondary coil;

(d) removing a portion of said conductor and (e) electrically connecting an electrical component in place of said removed portion of said conductor.

9. A method as recited in claim 8 wherein said portion of said conductor is removed by punching.

10. A method as recited in claim 9 wherein said electrical component is a leaded electrical component and wherein said component is connected by crimping at least one lead of said component to said conductor.

11. A method as recited in claim 9 wherein said electrical component is connected by soldering said component to said conductor.

12. A method as recited in claim 8 wherein said electrical component is a diode.

13. A method as recited in claim 10 wherein said electrical component is a diode.

14. A method as recited in claim 11 wherein said electrical component is a diode.

* * * * *